US006793538B2

(12) United States Patent
Huang

(10) Patent No.: US 6,793,538 B2
(45) Date of Patent: Sep. 21, 2004

(54) SLIM MODULAR JACK

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/302,462

(22) Filed: Nov. 22, 2002

(65) Prior Publication Data

US 2004/0102098 A1 May 27, 2004

(51) Int. Cl.[7] ..... H01R 24/00
(52) U.S. Cl. ..... 439/676
(58) Field of Search ..... 439/676, 607, 439/677

(56) References Cited

U.S. PATENT DOCUMENTS 4,457,570 A 7/1984 Bogese, II ..... 439/59
4,501,464 A 2/1985 Bogese, II ..... 439/344
5,791,942 A 8/1998 Patel ..... 439/637
5,797,770 A * 8/1998 Davis et al. ..... 439/607
6,099,351 A * 8/2000 Wu ..... 439/607
6,238,244 B1 * 5/2001 Yang ..... 439/607
6,264,504 B1 * 7/2001 Wu ..... 439/607
6,283,796 B1 * 9/2001 Yeh ..... 439/677
6,296,527 B1 * 10/2001 Zhang et al. ..... 439/676
6,364,700 B1 * 4/2002 Zhu et al. ..... 439/567
6,379,184 B1 * 4/2002 Bassler et al. ..... 439/607

* cited by examiner

*Primary Examiner*—Tulsidas C. Patel
(74) *Attorney, Agent, or Firm*—Wei Te Chung

(57) ABSTRACT

A slim modular jack (7) has a shell (1), a housing (2), and a terminal insert module (3) received in the housing. The shell has a front wall (10) and a pair of side walls (11) bending from the front wall. The housing has a substantially U-shaped body portion with an upper wall (21), a lower wall (22) and a rear side (23). The side walls of the shell act as side walls of the housing after the shell is assembled to surround the housing.

10 Claims, 6 Drawing Sheets

SLIM MODULAR JACK

BACKGROUND OF THE INVENTION

1. Field of the Invention

The present invention generally relates to electrical connectors, and more particularly to a slim type modular jack connector having an improved, simple structure.

2. Brief Description of the Related Art

Modular Jacks are often used in data communication networks to transmit signals. U.S. Pat. Nos. 5,791,942, 4,501,464, and 4,457,570 show such modular jacks. Each of these modular jacks has an insulative housing, a plurality of contacts, and a metal shield. The housing has a body portion including a pair of side walls, a top wall and a bottom wall. The shield has a pair of side plates, a top plate and a bottom plate to substantially surround the housing and to prevent electromagnetic interference (EMI). However, a thickness of the side walls of the housing and the side plates of the shield is relatively large and then the connector occupies a relatively large space.

Hence, an improved electrical connector occupying less space is needed to solve the above problems.

BRIEF SUMMARY OF THE INVENTION

It is an object of this invention to provide a slim type modular jack connector which occupies less space.

A modular jack in accordance with a preferred embodiment of the present invention includes an insulative housing, a terminal insert module, two pairs of light-emitting devices (LEDs) and a metal shell. The housing has an upper wall, a lower wall and a rear side together defining a cavity for receiving a complementary plug connector. The terminal insert module includes an insert portion and a plurality of terminals insert molded therein. The shell has two side walls, a top wall, a bottom wall and a rear wall. The side walls of the shell act as side walls of the housing after the shell is assembled to the housing.

Other objects, advantages and novel features of the invention will become more apparent from the following detailed description of a preferred embodiment when taken in conjunction with the accompanying drawings.

DETAILED DESCRIPTION OF THE INVENTION

Figure 1:
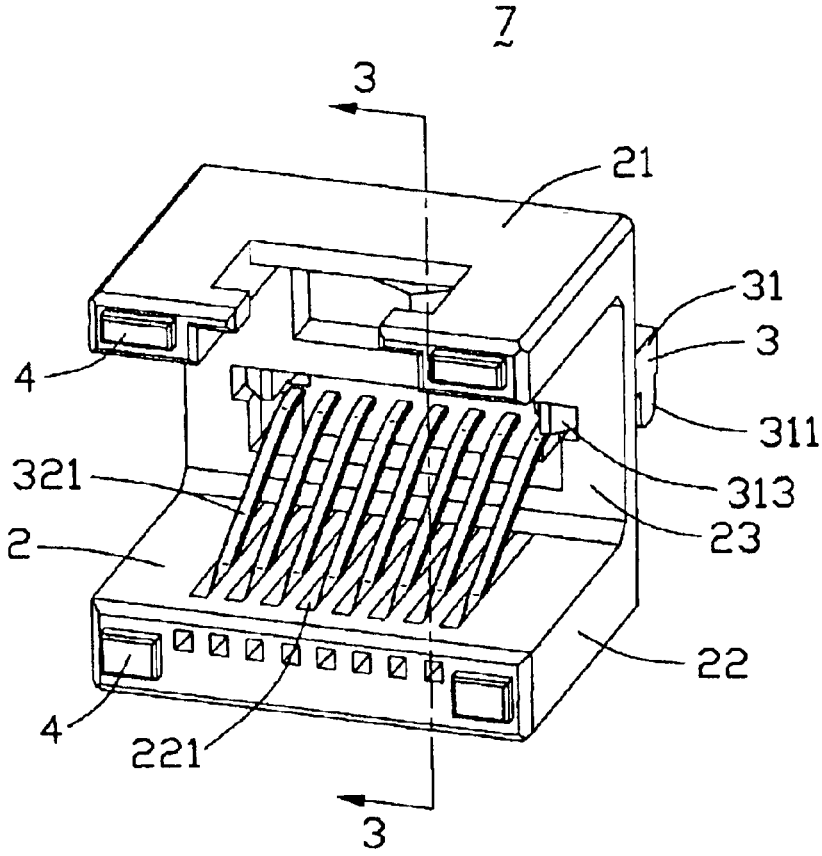
FIG. 1 is a perspective view of a modular jack of a preferred embodiment of the present invention wherein the shell is not assembled thereto.
Figure 4:
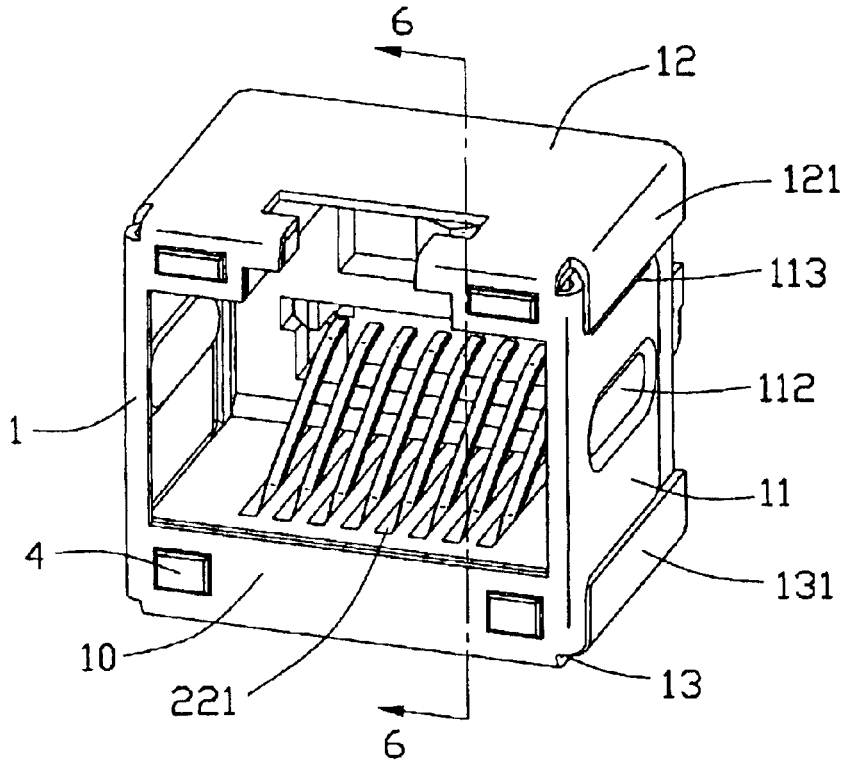
FIG. 4 is a perspective view of the modular jack of a preferred embodiment of the present invention wherein the shell is assembled thereto.

Referring to FIGS. 1 and 4, a modular jack 7 in accordance with the present invention has a metal shell 1, an insulative housing 2, a terminal insert module 3 received in the housing and two pairs of light-emitting devices (LEDs).

Figure 2:
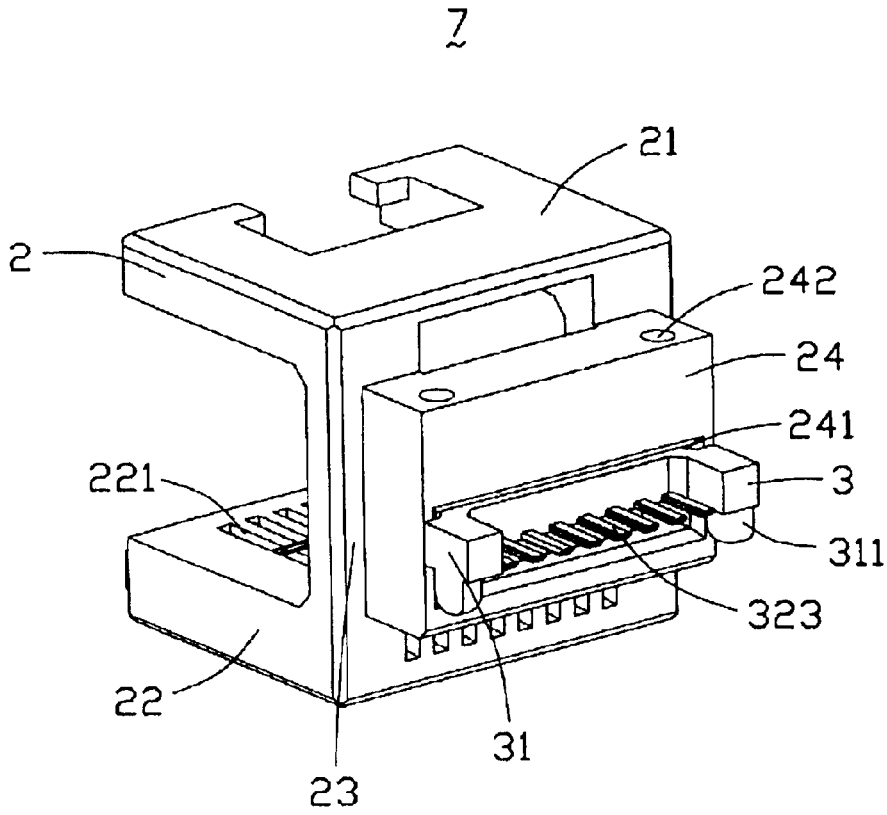
FIG. 2 is a view similar to FIG. 1, but viewed from a rear aspect.
Figure 3:
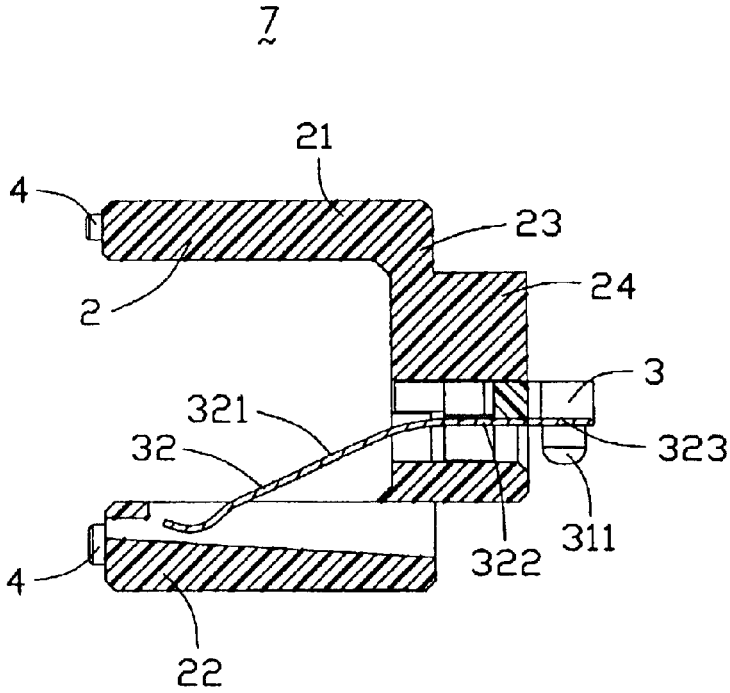
FIG. 3 is a cross-sectional view of FIG. 1 taken along line 3—3

Referring to FIGS. 1–3, the housing 2 is substantially in a U-shaped configuration and has an upper wall 21, a lower wall 22 and a rear side 23. The upper wall 21, the lower wall 22 and the rear side 23 together define a cavity (not labeled) for receiving a complementary plug (not shown). The lower wall 22 defines a plurality of passageways 221 extending therethrough from a front edge thereof to a rear edge thereof. The housing 2 further has a rear portion 24 formed on rear surface of the rear side 23. An opening 241 extends through the rear portion 24 and the rear side 23. Two mounting holes 242 are defined in an upper wall of the rear portion 24.

The terminal insert module 3 has an insert portion 31 and a plurality of terminals 32 insert molded therein. The insert portion 31 has a pair of spring arms (not labeled), a pair of positioning portions 311 respectively extending downwardly from rear free ends of corresponding spring arms, and a pair of locks 313 formed on front free ends of corresponding spring arms. Each terminal 32 has a horizontal retaining portion 322 fixed in the insert portion 31, a contact portion 321 extending forwardly and downwardly from the retaining portion 322, and a soldering portion 323 extending rearwardly and horizontally from the retaining portion 322.

Figure 5:
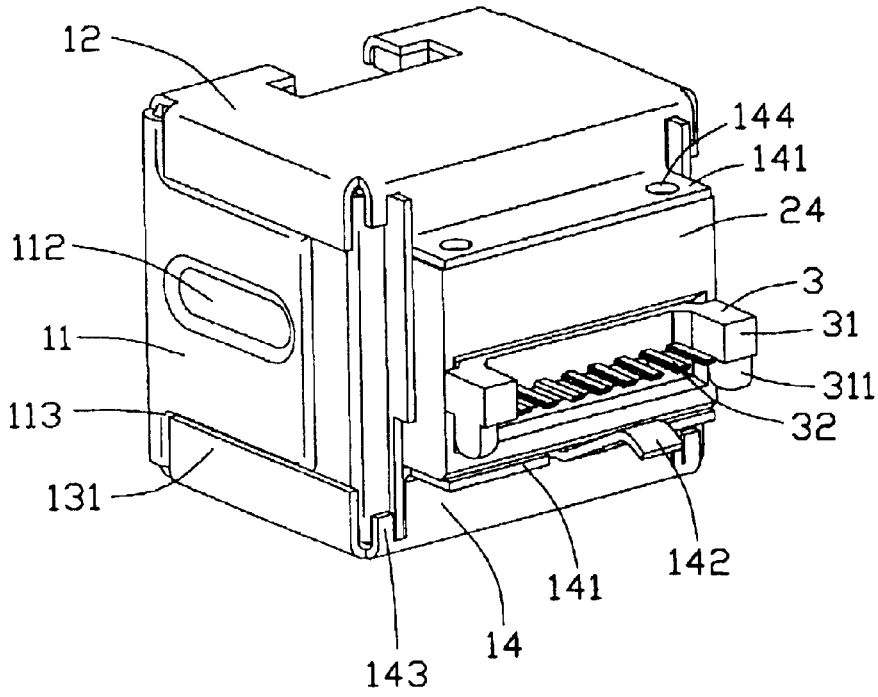
FIG. 5 is a view similar to FIG. 4, but viewed from a rear aspect.
Figure 6:
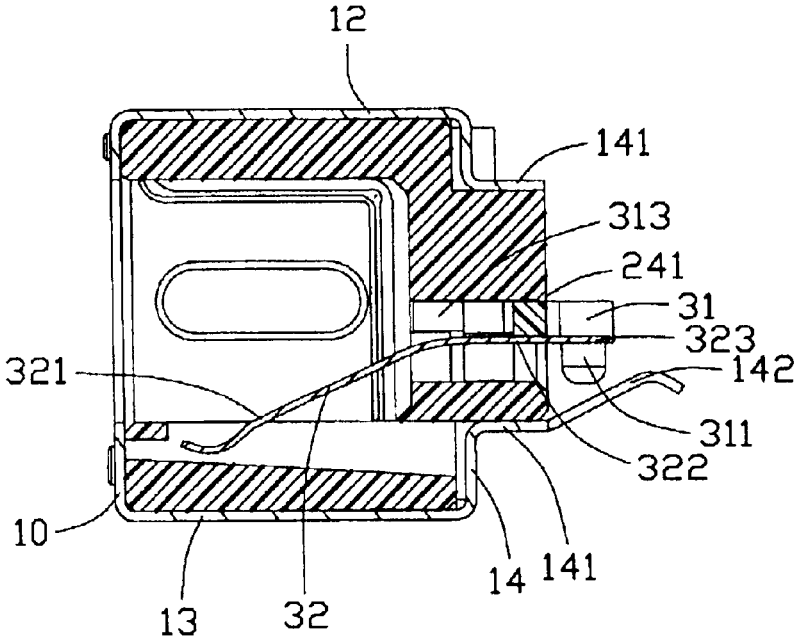
FIG. 6 is a cross-sectional view of FIG. 4 taken along line 6—6.

Referring to FIGS. 4–6, the shell 1 has a front wall 10, a pair of side walls 11 and a top and bottom walls 12, 13 respectively extending rearwardly from the front wall 10. Each side wall 11 defines a depression 112 in a middle portion thereof and a pair of recesses 113 in an upper and lower portions thereof. The top and bottom walls 12, 13 form flat portions 121, 131 respectively extending downwardly and upwardly from opposite sides thereof. In addition, the top and bottom walls 12, 13 are bent perpendicularly thereto and extend toward each other to form a rear wall 14. The rear wall 14, forms a pair of plate portions 141. The upper plate portion 141 defines two fixing holes 144, and the lower plate portion 141 forms a flexible grounding finger 142. The bottom wall 13 further has a pair of tabs 143 extending upwardly from a rear edge thereof.

Referring to FIGS. 4–6, in assembly, the pairs of LEDs 4 are received respectively in the upper and lower walls 21, 22 of the housing 2. The spring arms of the terminal insert module 3 are received in the opening 241 of the housing 2 with the locks 313 abutting against peripheral walls of the opening 241 and the contact portions 321 of the terminals 32 being received in the cavity and the passageways 221 of the housing 2 for engaging with terminals of the complementary plug. The shell 1 is attached to the housing 2 with the flat portions 121, 131 of the top and bottom walls 12, 13 respectively engaging with the recesses 113 of the side walls 11, and the tabs 143 abutting against the rear side 23 of the housing 2. The pair of the plate portions 141 of the rear wall 14 of the shell 1 respectively abut against the upper and lower walls of the rear portion 24 of the housing 2 with the fixing holes 144 thereof aligning with the mounting holes 242 of the rear portion 24. Thus the shell 1 and the housing 2 may be secured with each other by a connecting element (not shown) such as a screw bolt through the fixing holes 144 and the mounting holes 242. The grounding finger 142 extends rearwardly from and below the soldering portions 323 of the terminals 32.

In use, the modular jack is mounted on a printed circuit board (PCB, not shown), the positioning portions 311 of the terminal insert module 3 engaging with corresponding through holes of the PCB, the soldering portions 323 electrically connecting with corresponding circuit traces on one surface of the PCB, and the grounding finger 142 of the shell 1 electrically connecting with a grounding circuit trace on an opposite surface of the PCB.

An advantage of the present invention over the prior art is that the housing 2 of the modular jack 7 has no side walls, and the side walls 11 of the shell 1 serve as side walls of the housing 2 after the shell 1 is assembled to the housing 2. As a result, the housing 2 of the modular jack 7 has a smaller width than a conventional modular jack, so that the modular jack 7 occupies less space when mounted in a piece of electronic equipment.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A slim modular jack, comprising:

an insulative housing, the housing including an upper wall, a lower wall and a rear side joining the upper and lower walls together to define a substantially U-shaped receiving cavity, the rear side defining an opening therethrough;

a terminal insert module having an insert portion and a plurality of terminals retained in the insert portion and extending into the receiving cavity of the housing for engaging with contacts of a complementary plug, the insert portion having at least one positioning post extending downwardly and a pair of spring arms extending forwardly through the opening; and a shell substantially surrounding the receiving cavity of the housing.

2. The modular jack of claim 1, wherein the lower wall of the housing defines a plurality of passageways receiving free ends of corresponding terminals.

3. The modular jack of claim 1, wherein each spring arm forms a lock at a free end thereof, and the lock abutting against a peripheral wall of the opening.

4. The modular jack of claim 1, wherein each terminal has a retaining portion insert molded in the insert portion, a soldering portion extending horizontally and rearwardly from the retaining portion, and a contact portion tending downwardly and forwardly from the retaining portion.

5. The modular jack of claim 1, wherein the shell has a rear wall and a grounding finger extending rearwardly therefrom.

6. A slim modular jack comprising:

a main housing, the main housing defining a substantially U-shaped configuration, without side walls thereof, defining a cavity;

a terminal insert module including an insert portion engaging with the housing, and a plurality of terminals insert molded with the insert portion, the terminals extending into the cavity for mating with a complementary plug; and a shell having a pair of side walls; wherein the side walls of the shell are positioned at side edges of the housing and serve as the side walls of the housing.

7. A modular jack comprising:

an insulative housing defining a receiving space above an inner bottom face and in front of a rear side for accommodating a plug connector therein in a front-to-back direction;

a plurality of terminals extending in said receiving space and beyond said inner bottom face;

each of said terminals including a fixed end extending from the rear side and toward said inner bottom face and further through said inner bottom face; and a slanted surface is formed beneath said inner bottom face and corresponding to each of said terminals to allow a distal free end of each of said terminals to move obliquely and rearwardly along said slanted surface when said terminals are mated and urged by a corresponding contact of the plug.

8. The modular jack as described in claim 6, wherein the insert portion has at least one positioning post extending downwardly and a pair of spring arms latchablely engaging with the housing.

9. The modular jack as described in claim 8, wherein the housing has a rear side defining an opening extending therethrough, and wherein each spring arm forms a lock at a free end thereof abutting against a peripheral wall of the opening.

10. The modular jack as described in 6, wherein each terminal has a retaining portion insert molded in the insert portion, a soldering portion extending horizontally and rearwardly from the retaining portion, and a contact portion bending downwardly and forwardly from the retaining portion.

* * * * *